US005993712A

United States Patent [19]

Wandel et al.

[11] Patent Number: 5,993,712

[45] Date of Patent: Nov. 30, 1999

[54] PROCESS FOR THE PROCESSING OF POLYMER MIXTURES INTO FILAMENTS

[75] Inventors: Dietmar Wandel, Hanau; Joachim Cziollek, Mainz; Ulrich Thiele, Bruchkoebel; Alexander Klein, Ingelheim; Heinz-Dieter Schumann, Maintal, all of Germany

[73] Assignee: Lurgi Zimmer Aktiengesellschaft, Frankfurt, Germany

[21] Appl. No.: 09/123,769

[22] Filed: Jul. 28, 1998

Related U.S. Application Data

[63] Continuation-in-part of application No. 08/937,705, Sep. 25, 1997, abandoned.

[30] Foreign Application Priority Data

Feb. 25, 1997 [DE] Germany ..... 197 07 447

[51] Int. Cl.[6] ..... D01D 5/12; D01F 6/60; D01F 6/62; D02G 3/00

[52] U.S. Cl. ..... 264/103; 264/210.5; 264/210.8; 264/211.12

[58] Field of Search ..... 264/103, 210.5, 264/210.8, 211.12

[56] References Cited

U.S. PATENT DOCUMENTS

| | | | |
|---|---|---|---|
| 4,356,234 | 10/1982 | Kumakawa et al. | 428/372 |
| 4,442,057 | 4/1984 | Brody et al. | 264/211.22 |
| 4,446,299 | 5/1984 | Koschinek et al. | 528/272 |
| 4,518,744 | 5/1985 | Brody et al. | 525/184 |
| 4,609,710 | 9/1986 | Iohara et al. | 525/176 |
| 4,940,559 | 7/1990 | Kretschmann et al. | 264/130 |
| 5,373,057 | 12/1994 | Watanabe et al. | 525/176 X |
| 5,565,522 | 10/1996 | Bohringer et al. | 525/176 |

FOREIGN PATENT DOCUMENTS

| | | |
|---|---|---|
| 35796 A1 | 9/1981 | European Pat. Off. . |
| 41327 B1 | 9/1983 | European Pat. Off. . |
| 47464 B1 | 1/1985 | European Pat. Off. . |
| 80274 | 5/1986 | European Pat. Off. . |
| 346641 B1 | 8/1994 | European Pat. Off. . |
| 631638 B1 | 8/1994 | European Pat. Off. . |
| 19519898 A1 | 12/1996 | Germany . |
| 56-85420 | 7/1981 | Japan . |
| 56-91013 | 7/1981 | Japan . |

*Primary Examiner*—Leo B. Tentoni
*Attorney, Agent, or Firm*—McDonnell, Boehnen Hulbert & Berghoff

[57] ABSTRACT

The invention concerns a method of processing polymer blends based on polyester or polyamide with a draw-off speed of ≧1500 m/min to produce filaments with an elongation at break of ≦180%, where a second amorphous polymer is added to the polyester or polyamide in the amount of 0.05 to 5 wt % and the polymer is a copolymer composed of at least two of the following monomer units:

0 to 90 wt % A, wherein A is a monomer of formula $CH_2{=}C(R){-}COOR^1$, wherein R is —H or —$CH_3$ and $R^1$ is straight or branched chain $C_1$–$C_{10}$ alkyl or cyclohexyl.

0 to 40 wt % B, wherein B is a monomer of maleic acid or maleic anhydride, and 5 to 85 wt % C, wherein C is a monomer of styrene or methyl substituted styrene such that (wt % A+wt % B+wt % C)=100, and these filaments are processed by a drawing process or a stretch texturing process at high speeds. Preferably $R^1$ is methyl, ethyl, n-propyl, n-butyl, iso-butyl, 2-ethyl-butyl, 2-ethyl hexyl, n-hexyl, n-heptyl, or cyclohexyl. Preferably, C is styrene, α-methyl styrene, 3-methyl styrene, or 4-methyl styrene. Most preferably C is styrene.

22 Claims, 8 Drawing Sheets

PROCESS FOR THE PROCESSING OF POLYMER MIXTURES INTO FILAMENTS

This is a continuation-in-part of U.S. application ser. No. 08/937,705, filed Sep. 25, 1997, now abandoned.

BACKGROUND OF THE INVENTION

1. Field of the Invention

The present invention relates to a process of producing filaments with an elongation at break of ≦180% by spinning polymer blends based on polyester or polyamide with an amorphous second polymer at a draw-off speed of ≧1,500 m/min.

2. Summary of the Related Art

Spinning of polymer blends is known from several publications:

Japanese Patent 56-85420 A (Teijin) describes an undrawn polyamide (nylon) yarn, where an improved productivity is achieved by adding 0.5–10 wt % of a bisphenol polycarbonate.

European Patent No. 35, 796 A (Teijin) describes synthetic fibers, including those made of polyester or polyamide containing 1–15 wt % of a polysulfone polymer having a high glass transition temperature $T_g$≧150° C. The additive remains in a spheroidal form in the matrix and affects the surface structure of the filaments and the fiber friction. The spinning speed is 2000–5500 m/min.

European Patent No. 41,327 B (ICI) discloses fibers of PET or nylon-66 containing 0.1–10 wt % of another polymer with anisotropic properties (LCP grades). The spinning speeds amount to 1000–5000 m/min. A wind-up speed suppression (WUSS, i.e., the properties of the fibre spun from polymer mixture are those that would be obtained from a fibre spun from the non-mixed polymer at lower wind-up speed) is achieved due to the higher elongation at break of the spun fiber and thus higher drawing ratios and a greater increase in productivity.

European Patent No. 80,274 B (ICI) concerns fibers of PET, nylon-66 or polypropylene containing 0.1–10 wt % of another polymer that is present in the melt with an average particle size of 0.5–3 μm and is deformed to fibrils in melt spinning. The spinning speeds are 2000 to 6000 m/min, where a speed suppression (WUSS) of at least 20% is achieved due to the greater elongation at break and the lower birefringence of the (PET) spun fiber, and, thus, higher drawing ratios and increased productivity are achieved. Preferred polymer additives include polyethylene glycol or nylon-66 for PET or polyolefins for nylon-66. The effect is extremely sensitive to production parameters such as throughput, spinning temperature, type of blending and type of extruder. Due to the sensitivity of the process, it is difficult to transfer the process to production facilities of a different capacity, types of equipment, or titer programs.

Japanese Patent 56-91013 A (Teijin) discloses an undrawn polyester yarn, where an improved productivity is achieved by adding 0.5–10 wt % of a styrene polymer. The improvement is due to the increase in elongation at break of the spun fiber at speeds between 850 and 8000 m/min, preferably ≧2500 m/min, and accordingly higher drawing ratios.

European Patent No. 47,464 B (Teijin) discloses an undrawn polyester yarn, where an improved productivity is achieved by adding 0.2–10 wt % of a polymer of the type —$(CH_2CR_1R_2)_n$— such as poly(4-methyl-1-pentene) or polymethyl methacrylate. The improvement is due to the increase in elongation at break of the spun fiber at speeds between 2500 and 8000 m/min. Higher drawing ratios are achieved accordingly. It is important to achieve a fine and uniform dispersion of the polymer additive by mixing, where the particle diameter must be ≦1 μm to prevent the development of fibrils. The effect is determined by the interaction of three properties—the chemical additive structure, which hardly allows elongation of the additive molecules, the lower mobility and the compatibility of polyester and additive.

European Patent No. 631,638 B (AKZO) discloses fibers mainly of PET containing 0.1–5 wt % of a 50–90% imidized polyrnethacrylate alkyl ester. The fibers obtained at spinning speeds of 500–10,000 m/min and subsequent drawing have a higher initial modulus. Spinning at very high speeds (such as 8000 m/min) should be possible at conventional thread breakage rates. At speeds up to 8000 m/min, partially oriented fibers are obtained that have not yet been drawn to the final elongation and can be processed to yield textured yarns, for example. In the case of industrial yarns, the effect on the modulus cannot be easily reproduced; the strength achieved is generally lower, which is a great disadvantage for this product. Only drawn yarns have been described for textile applications. The respective undrawn yarns at spinning speeds in excess of 6000 m/min yield an elongation at break of ≦65.3%, which is not suitable for further processing by draw texturing or stretch texturizing because of the high crystallization associated with this value (boiling shrinkage ≦6.5%).

One of the goals of spinning polymer blends to synthetic fibers is to obtain a greater elongation at break in the spun fiber at a certain spinning speed than is possible without modification by the added polymer. This permits a higher drawing ratio in production of the final yarn, which should permit a greater productivity of the spinning unit. According to European Patent No. 41,327 B, the gain in productivity to be expected can be calculated by the equation:

$$\text{gain in productivity} = \frac{\left(1+\frac{E'}{100}\right)-\left(1+\frac{E}{100}\right)}{\left(1+\frac{E}{100}\right)}\cdot 100\%$$

where E/E' is the unmodified/modified elongation at break. Reviewing this equation shows that the effect is greatest when the increase in elongation (E–E') is great. However, an excessive elongation and thus a reduced orientation of the spun fiber are not suitable for processing in high-speed stretch texturizing processes.

Another method of increasing the productivity is described by the parameter WUSS ≧20% in European Patent No. 80,274 B. With a spinning speed at least 20% higher, the same elongation at break is obtained in the spun fiber as at a lower speed with unmodified polymer. However, that publication does not disclose the running behavior at high speeds in the spinning mill or in further processing units or any properties of the final yarns produced there.

Increasing production rate tends to improve the profitability of the manufacturing process. On the other hand, profitability is reduced to a certain extent by production problems and expensive high-speed equipment. The additional cost of the polymer additive has a significant effect, so there is actually a zero point for profitability as a function of the amount added. The market availability of the polymer additive also plays an important role. For these reasons, many of the additives described in the literature are unsuitable for large-scale industrial implementation.

The producer or contractor must take into account the entire production chain and cannot balk at an increase in production in a substep (e.g., in the spinning mill). Follow-up processes must not be impaired. In particular, one of the main goals of this invention is not to limit the further processing conditions in the subsequent steps, but preferably to improve them and to accomplish this despite the increased spinning speed.

Thus, in the prior art a very high elongation at break is achieved for polymer blends also at high spinning speeds that correlate with a great reduction in orientation. Such spun fibers are known to be unstable in storage and cannot be fed or processed at high speeds in friction texturing processes. On the other hand, an elongation of <70% at break at high spinning speeds indicates a high degree of crystallization that reduces the strength achieved in the texturing process. For highly oriented yarns (HOY) using extremely high spinning speeds in the spinning process, an increase in elongation at break is problematical for the mechanical stability of the yarn in textile processing operations such as weaving. The increased elongation reduces the orientation, which in turn results in a lower modulus, which can be regarded as having a negative effect on quality.

SUMMARY OF THE INVENTION

The object of the present invention is to provide a process for producing filaments that have an elongation at break of ≦180% and have little or none of the disadvantages mentioned above, the method comprising processing polymer blends based on polyester or polyamide with an amorphous second polymer and subjecting the blends to high-speed spinning at a draw-off speed of ≧1500 m/min. In particular, the second polymer additive to be added to the polyester or polyamide should be inexpensive, should, when spun, yield an increase in production in comparison with a matrix polymer that is not modified and should permit processing of the spun fibers at high speeds.

The present invention achieves the foregoing objective by adding to a polyester or polyamide blend a copolymer composed of at least two of:

0 to 90 wt % A, wherein A is a monomer of formula $CH_2{=}C(R)—COOR^1$, wherein R is —H or —$CH_3$ and $R^1$ is straight or branched chain $C_1$–$C_{10}$ alkyl or cyclohexyl, 0 to 40 wt % B, wherein B is a monomer of maleic acid or maleic anhydride, and 5 to 85 wt % C, wherein C is a monomer of styrene or methyl substituted styrene such that (wt % A+wt % B+wt % C)=100, and subjecting the resulting blend to high-speed spinning at a draw-off speed of ≧1500 m/min to form filaments. Preferably $R^1$ is methyl, ethyl, n-propyl, n-butyl, iso-butyl, 2-ethyl-butyl, 2-ethyl hexyl, n-hexyl, n-heptyl, or cyclohexyl. Preferably, C is styrene, α-methyl styrene, 3-methyl styrene, or 4-methyl styrene. Most preferably C is styrene.

DETAILED DESCRIPTION OF THE PREFERRED EMBODIMENTS

Figure 1A:
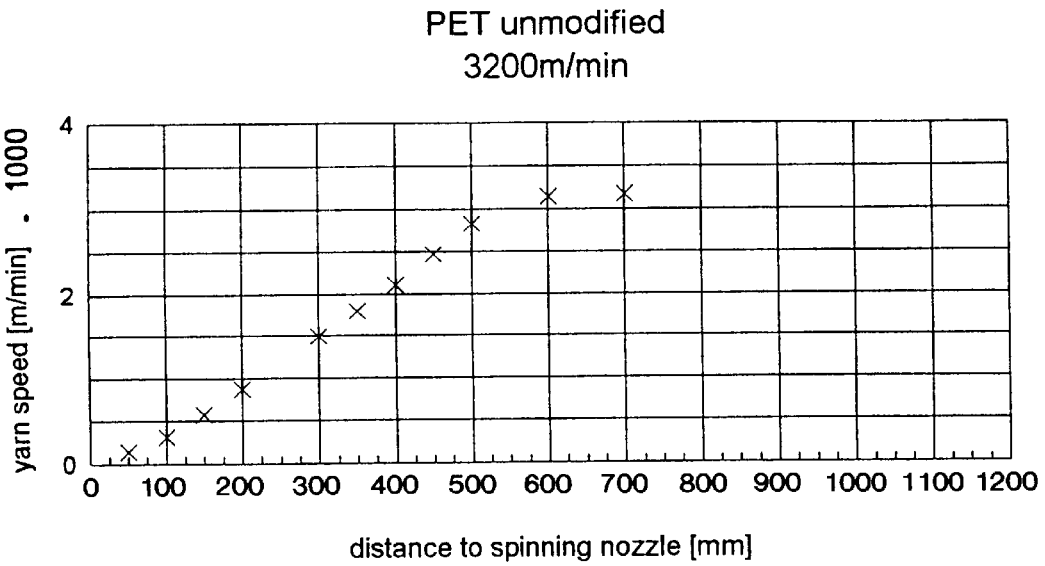
FIGS. 1 A–B displays the fiber speed and deformation zone measurements of Example 1.

The present invention provides an improved process for producing filaments that have an elongation at break of ≦180% comprising adding 0.05 to 5 wt % of a second amorphous polymer to a polyester or polyamide, wherein the second polymer is a copolymer composed of at least two of the following monomer units:

0 to 90 wt % A, wherein A is a monomer of formula $CH_2{=}C(R)—COOR^1$, wherein R is —H or —$CH_3$ and $R^1$ is straight or branched chain $C_1$–$C_{10}$ alkyl or cyclohexyl, 0 to 40 wt % B, wherein B is a monomer of maleic acid or maleic anhydridc, and 5 to 85 wt % C, wherein C is a monomer of styrene or methyl substituted styrene such that (wt % A+wt % B+wt % C)=100, and subjecting the resulting blend to high-speed spinning at a draw-off speed of ≧1500 m/min to form filaments. Preferably $R^1$ is methyl, ethyl, n-propyl, n-butyl, iso-butyl, 2-ethyl-butyl, 2-ethyl hexyl, n-hexyl, n-heptyl, or cyclohexyl. Preferably, C is styrene, α-methyl styrene, 3-methyl styrene, or 4-methyl styrene. Most preferably C is styrene.

The additive polymer (second polymer) must be amorphous, largely insoluble in the matrix polymer and thus essentially incompatible, and it must permit the development of two phases that can be differentiated microscopically. Preferably the additive polymer contains 50 to 85 wt % A, 5 to 20 wt % B and 5 to 30 wt % C (total=100%) and more preferably 60–80 wt % methyl methacrylate units, 5–15 wt % maleic anhydride units and 15–25 wt % styrene units (total=100%). Suitable commercial products are GHT 120 from Degussa AG, Frankfurt, Germany or HW 55 from Röhm GmbH, Darmstadt, Germany. STAPRON SZ 26180 from DSM N.V., Herleen, Netherlands is an example of a polymer additive according to this invention consisting of two monomer components, namely about 74 wt % styrene and about 26 wt % maleic anhydride. For many applications it is sufficient to add ≦2.5%, which permits a considerable cost advantage.

Polyesters such as polyethylene tereplhtlhalate (PET) or polyamides such as nylon-6 or nylon-66 may be used as the fiber-forming matrix polymer. The homopolymers are preferred. However, copolymers with a co-monomer content of up to about 15 mol % may also be used. In the case of PET, for example, these may be diethylene glycol, 1,4-cyclohexanedimethanol, polyethylene glycol, isophthalic acid and/or adipic acid. In addition, the polymers may also contain additives such as catalysts, stabilizers, optical brighteners and delustering agents. PET may also contain a small amount of branching component such as polyfunctional acids, e.g., trimellitic acid, pyromellitic acid or tri- or tetravalent alcohols, such as trimethylolpropane, pentaerythritol, glycerol or corresponding hydroxy acids.

The polymer additive (second polymer) is blended with the matrix polymer by adding the former as a solid to matrix polymer chips in the extruder feed with a chips mixer or gravimetric metering or, as an alternative, by melting the polymer additive, metered addition by gear pump, and feed into the melt stream of the matrix polymer. Then a homogeneous distribution is achieved by mixing in the extruder or by means of static or dynamic mixers in an essentially known manner.

The design of the spinning package is important; it is equipped with filter units and/or loose filter media (e.g., steel shot) of a defined particle size. To establish an adequate shearing of the additive, a specific nozzle pressure was established. The shearing effect in the nozzle package was evaluated by spinning a melt stream both with and without a built-in nozzle package, taking a sample of the discharged filament product under otherwise the same pretreatment parameters, and then counting and measuring the additive particles by electron microscopy. As a result of the incompatibility of the two polymers, the polymer additive forms spheroidal particles in the matrix polymer. The best conditions were obtained when the average particle size $d_{50}$ was ≦400 nm, and when the number of particles >1000 nm in a specimen cross section was less than 1%. The effect of spin-drawing on these particles could not be detected analytically.

The contradictory effects of fibrillation and the roller effect described in the literature could not be reproduced with the polymer additive according to this invention. We assume that deformation of the matrix takes place in the boundary layer between matrix polymer and the second polymer under conditions that result in a reduction in orientation and suppression of spin-induced crystallization, and we also assume that each polymer has a specific behavior. Suitable standards are the effect on development of the spun fiber and the processing properties.

The synthetic filaments are produced by high-speed spinning with draw-off speeds of ≧1500 m/min using known spinning equipment.

The molten polymer blend is pressed through the boreholes in the nozzle plate after completing the shearing and filtration treatment in the nozzle package. In the downstream cooling zone the melt fibers are cooled by cooling air to a temperature below their softening point to prevent sticking or compaction on the following thread guide element. The design of the cooling zone is not critical if a homogeneous stream of air that passes uniformly through the filament bundle is guaranteed. Thus an air resting zone can be provided directly below the nozzle plate to delay cooling. The cooling air can be supplied by transverse or radial flow from an air conditioning system or it may be taken from the ambient air by automatic intake through a cooling tube.

After cooling, the filaments are bundled and treated with spinning oil. Oiler stones to which spinning oil is supplied as an emulsion by metering pumps are used for this purpose. The prepared fiber preferably passes through an entangling device to improve thread compactness. Handling and security devices can also be installed along the fiber path before the fiber reaches the winding apparatus where it is wound onto cylindrical bobbin bodies to form packages. The circumferential velocity of the fiber package is regulated automatically and is equal to the spooling speed. The draw-off speed of the fiber can be 0.2–2.5% higher than the spooling speed because of its traversing movement.

Optionally driven godet wheels can be interposed after preparation or before spooling. The circumferential speed of the first roll system is equal to the draw-off speed. Additional rolls can be used for drawing or relaxing.

Processing of spun fibers by the drawing process or a stretch texturing process at high speeds is performed as follows: drawing can take place in one or two steps. In one step the draw-off speed is ≧1500 m/min, where the fibers pass at least through a drawing, zone formed by driven godet wheels and then are wound up as a drawn flat yarn at speeds of ≧4000 m/min after thermosetting. In the two-step process the spun fibers are first wound up at ≧1500 m/min, then fed to the drawing machine where they are drawn at speeds of at least 800 m/min, preferably ≧1000 m/min.

Spun fibers as roving for draw texturing—usually referred to as POY—are produced at draw-off speeds of ≧3600 m/min. Preferably the additive polymer is added in a sufficient amount for the elongation at break of these spun fibers to amount to 60 to 180% for nylon and to 85 to 180%, preferably 95 to 145% for PET. Draw texturing is performed according to the type of filament titer, where speeds of ≧750 m/min, preferably ≧900 m/min are used for normal titer filaments.

In the flat yarn process with stretching either in line between godets or without godets by sufficient high spinning speeds an elongation at break of 10 to 70% for nylon and 10 to 45%, preferably 20 to 45% for PET is achieved. Fully drawn flat yarns (HOY) produced by high spin drawing are drawn off and wound up at speeds of ≧6000 m/min.

It is a known fact that the spun fiber structure is formed to a great extent in the deformation zone below the spinneret, i.e., the zone in which the running speed of the fiber increases due to the deformation by stress of the solidifying fiber. It has been found that the length of the deformation zone is a quantitative measure of the physical fiber structure, which in turn influences the processing of the spun fibers. Thus, this parameter is not inherent in conventional parameters but instead is an independent quantity. The length of the deformation zone is varied through the fiber draw-off speed in the case of unmodified polymer. Typical values for roving at conventional draw-off speeds of at least 2500 m/min are lengths of approximately 300 mm, and preferably ≧250 mm to ≦700 mm, for POY, and approximately ≦200 mm, and preferably ≦100 mm, for finished drawn spun fibers.

It has been found that, in comparison with conventional processes, an increase in draw-off speed in spinning polymer blends with a suitable quantity of polymer additive yields spun fibers with good qualities with regard to processing at high speeds to drawn or draw-textured filaments.

When the draw-off speed is varied, the amount of second polymer added is adjusted so that the length value of the deformation zone corresponds to that of the unmodified matrix polymer. It has been found that for roving for draw texturing, the added quantity M of the second polymer must correspond at most to the following value for draw-off speeds v of 2500 to approximately 8000 m/min:

$$M = \left[\frac{1}{1600} \cdot v(\mathrm{m/min}) - 1\right]\%$$

and preferably at least:

$$M = \left[\frac{1}{1600} \cdot v(\mathrm{m/min}) - 2.48\right]\%$$

to achieve optimal results.

It has also been found that the amount of the second polymer added, P, for fully drawn yarns (HOY) that have been highly oriented only by spin drawing must correspond at most to the following value at winding speeds of ≧6000 m/min:

$$P = \left[\frac{1}{1600} \cdot v(\mathrm{m/min}) - 3.46\right]\%.$$

This value P is lower than that (M) required for roving for draw texturing.

EXAMPLES

The values of the properties given in the examples below were determined as follows:

Distribution of additive particles: melt strands or extrusion samples were shattered with a sharp chisel in liquid nitrogen. The fracture surfaces were tested by means of scanning electron microscopy and subsequent analysis of images. Three fractures of each sample with four SEM micrographs of each were evaluated. Owing to the low contrast between the matrix and additive, each additive particle was marked individually in the image analysis. The analysis was based on an elliptical extent (spheroidal), where the length, width and, calculated from these values, the average diameter were evaluated.

Fiber speeds were determined by laser Doppler anemometry. In this method a laser beam was split and the two split beams were made to intersect on the object to be measured. The interference frequency was measured in the backscatter range and the object speed calculated from the displacement in the interference frequency. In the present case, a diode laser with a power of 10 mW was used (distributed by TSI GmbH, Aachen, Germany, model LS50M). The fiber speed was measured at several distances below the spinneret and plotted graphically. The spin deformation zone was characterized by the change in speed until reaching the speed defined by the draw-off device. The length in millimeters between the speed points 1000 m/min and 90% of the final speed was defined as a standard measure. This deformation length usually amounted to several hundred millimeters. In the extreme case of high spinning speeds, it may be shortened to approximately 100 mm. In this case the familiar necking phenomenon occurs; then the change in fiber speed at speeds above approximately 1750 m/min, occurs almost in one point.

The intrinsic viscosity was determined on a solution of 0.5 g polyester in 100 ml of a mixture of phenol and 1,2-dichlorobenzene (3:2 parts by weight) at 25° C.

The strength properties of the spun fibers and their shrinkage at the boil were determined as described in U.S. Pat. No. 4,446,299, the Uster values were determined as described in European Patent No. 346,641 B, and the birefringence was determined as described in published German Patent Application No. 19519898 A.

The crimp characteristics of the textured filament yarns (nominal titer up to 500 dtex) were determined according to DIN 53,840, part 1.

The depth of color in dyeing was determined according to DIN 54,001 on a knit tube dyed with Terasil marine blue GRL-C 200% (Ciba-Geigy, Basel, Switzerland) by comparative measurement of the color reflectance with a reflection photometer.

Example 1

Comparison

Polyethylene terephthalate with an intrinsic viscosity of $\eta_{intr}$=0.64 dL/g and a residual water content of 32 ppm was melted in a single-screw extruder and sent to a spinning nozzle package at a temperature of 296° C. through a product line with nine static mixing elements (model SMX from Sulzer AG, Zurich, Switzerland) by means of a gear wheel metering pump.

As seen in the direction of melt flow, the nozzle package contained defined shearing and filtration agents of the following design: steel pellet volume, grain size 177–250 μm and height 30 mm, cloth filter with a superfine filter of 40 μm, supporting plate, second cloth filter of 40 μm, spinning nozzle plate with 34 holes, hole diameter 0.25 mm, L=2D and a plate diameter of 80 mm, corresponding to a filter area of 40 $cm^2$. As polymer throughput was varied, a polymer pressure in the range of 90–200 bar was established after the spinning pump.

The melt fibers coming out of the holes of the nozzle plate were cooled in a conventional quench duct with transverse flow, where the air velocity was set at 0.45 m/sec.

The cooled fibers were bundled by means of an oiler pin at a distance of 1200 mm below the spinning nozzle and provided with an emulsion of spinning oil in water, where the amount of preparation applied to the fiber was 0.4%.

The fiber bundle was drawn off by means of two godet wheels around which the fiber was wrapped in an S-shaped pattern and wound up into yarn packages on tubes in a winder from Barmag AG, Remscheid, Germany, model SW7, with birotor traversing. The spinning draw-off rate was determined by the circumferential speed of the godet wheels. The winding speed was set approximately 1% lower so that a fiber tension of 10 cN was obtained between the godet wheels and the winder. The nominal titer of the fiber produced in this way was 84f34 dtex.

The draw-off rate was set at 3200 m/min, where polymer was fed to the spinning nozzle at the rate of 41.4 g/min. In a second experiment, the draw-off rate was increased to 5000 m/min and at the same time the polymer feed rate was set at 63 g/min. The characteristics of these spun fibers are summarized in Table 1.

TABLE 1

| Comparative experiment no. | 1 | 2 |
|---|---|---|
| Draw-off Speed (m/min) | 3200 | 5000 |
| Titer (dtex) | 130 | 128 |
| Tensile strength (cN/tex) | 25.3 | 35.6 |
| CV breaking load (%) | 2.6 | 1.9 |
| Elongation at break (%) | 117.3 | 59.7 |
| CV elongation at break (%) | 2.3 | 2.8 |
| Uster - half inert (U %) | 0.23 | 0.24 |
| Uster - normal (U %) | 0.66 | 0.46 |
| Shrinkage at boil (%) | 64 | 6.6 |
| Birefringence ($10^{-3}$) | 48.4 | 70.9 |
| Drawing zone (mm) | 288 | 89 |
| CV speed (%) | 3.2 | 29 |

(CV = coefficient of variation deformation)

Figure 1B:
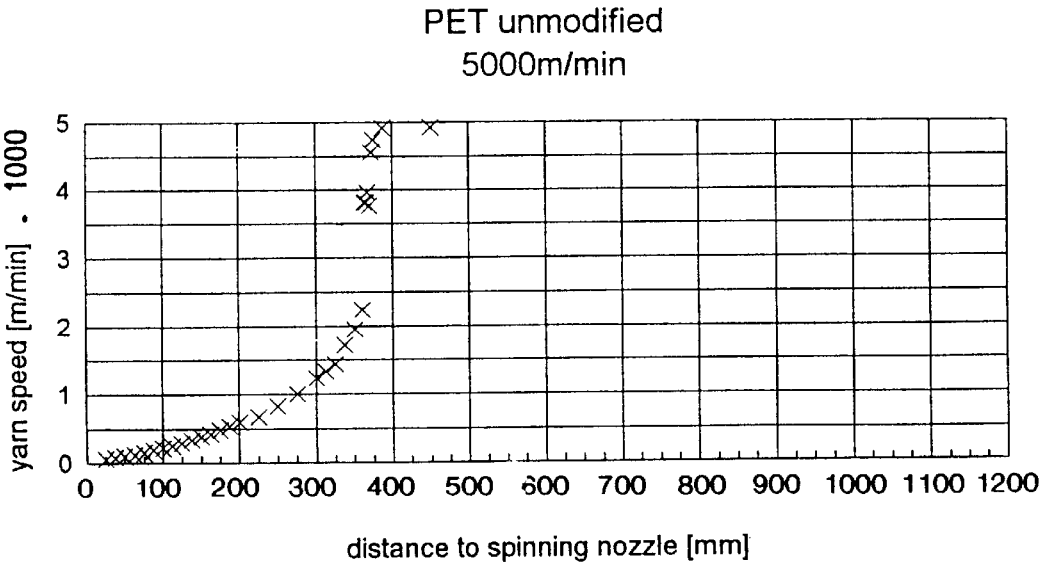

The fiber speed and deformation zone measurements are illustrated in FIG. 1. At 5000 m/min, the necking phenomenon (reduction in cross section) is apparent. The fluctuation in speed at the necking point (CV %) is also much more irregular.

The spun fibers from both experiments were processed further at a speed of 800 m/min in a refitted Barmag draw texturing machine, model FK6-S-900, equipped with a Barmag disk unit, model 7, with CO.85 ceramic disks, configuration 1-5-1, D/Y=2.2, and heater temperatures for heaters 1 and 2 of 195 and 160° C., respectively. The drawing ratio was adapted to the characteristics of the spun fiber and is summarized in Table 2 with the resulting characteristics of the textured yarn.

TABLE 2

Results of draw texturing of experiments nos. 1 + 2

| Comparative experiment no. | 1 | 2 |
|---|---|---|
| Draw-off rate (m/min) | 3200 | 5000 |
| Drawing ratio (1:) | 1.68 | 1.17 |
| Tension F1/F2 (cN) | 28/37 | 35/39 |
| Titer (dtex) | 80 | 116 |
| Tensile strength (cN/tex) | 42.0 | 34.4 |
| Elongation at break (%) | 23.3 | 26.0 |
| Crimp contraction (%) | 20 | 21 |
| Crimp retention (%) | 85 | 82 |
| Depth of color (%) | 100 | – |
| Processing behavior | + | – |

(+ = positive,
– = negative)

Although yarn No. 1 according to the state of the art could be processed well, problems occur in the form of breakage and thread tension defects when the spinning speed is increased to 5000 m/min, and the drawing ratio to be used must be reduced greatly. The strength that can be achieved is also lower. The reason is the increased degree of crystallinity of the POY spun fiber and is characterized by a low elongation at break and by the necking behavior in spin drawing.

Example 2

In the spinning system according to Example 1 and under the same spinning conditions, a polymer additive was added to the polyethylene terephthalate chips in the form of granular particles in various concentrations. The polymer additive was a commercial product of Röhm GmbH, Darmstadt, Germany, type HW55, corresponding to a random copolymer of methyl methacrylate, styrene and maleic anhydride according to this invention.

The spinning draw-off speed, however, was set constantly at 5000 m/min. The polymer throughput was 63 g/min. The nozzle pressure was in the range of 135 to 185 bar. Table 3 shows the characteristics of the spun fibers.

TABLE 3

| Experiment no. | 3 | 4 | 5 | 6 |
|---|---|---|---|---|
| Additive concentration (wt %) | 0.3 | 0.6 | 1.0 | 1.65 |
| Titer (dtex) | 129 | 128 | 129 | 129 |
| Tensile strength (cN/tex) | 30.8 | 27.0 | 24.0 | 18.7 |
| CV breaking load (%) | 2.6 | 2.5 | 2.2 | 3.2 |
| Elongation at break (%) | 71.6 | 85.5 | 112.8 | 144.5 |
| CV elongation at break (%) | 3.7 | 3.1 | 1.9 | 2.4 |
| Uster - half inert (U %) | 0.17 | 0.31 | 0.24 | 0.36 |
| - normal (U %) | 0.44 | 0.62 | 0.51 | 0.59 |
| Shrinkage at boil (%) | 11.0 | 16.4 | 35.1 | 43.6 |
| Birefringence ($-10^{-3}$) | 64.5 | 57.9 | 43.4 | 26.5 |
| Drawing zone (mm) | 119 | 285 | 378 | 326 |
| CV speed (%) | 53 | 6.1 | 3.2 | 3.7 |

Figure 2A:
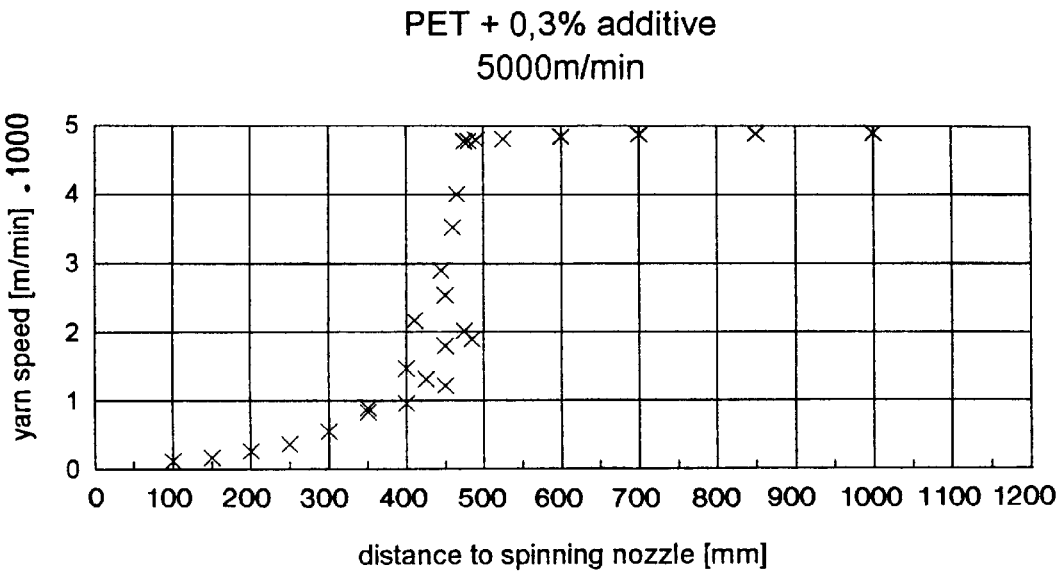
FIGS. 2 A–B and FIGS. 3 A–B display the measurement of the deformation zone of Example 2.
Figure 2B:
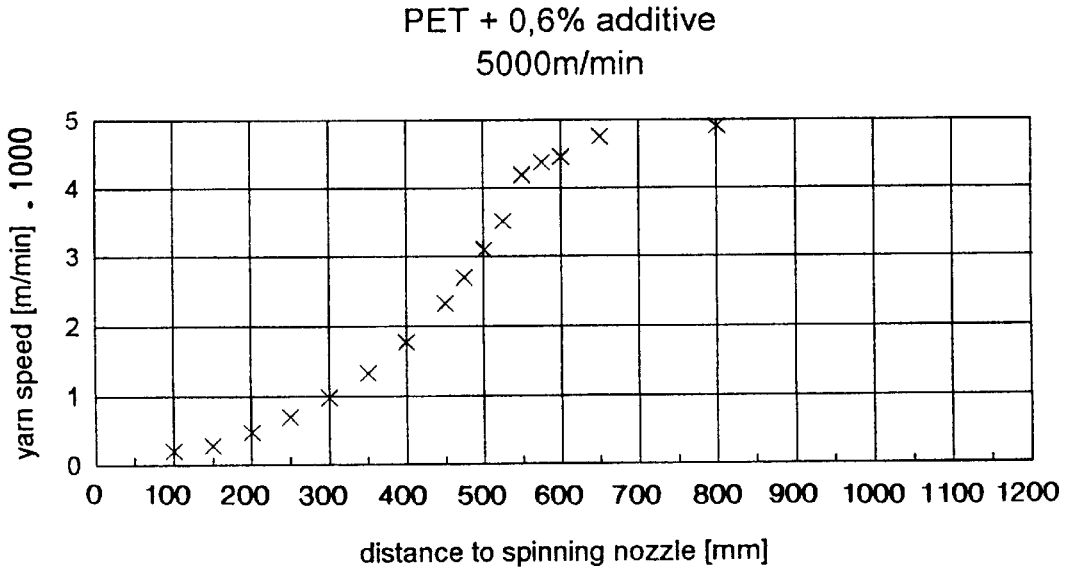
Figure 3A:
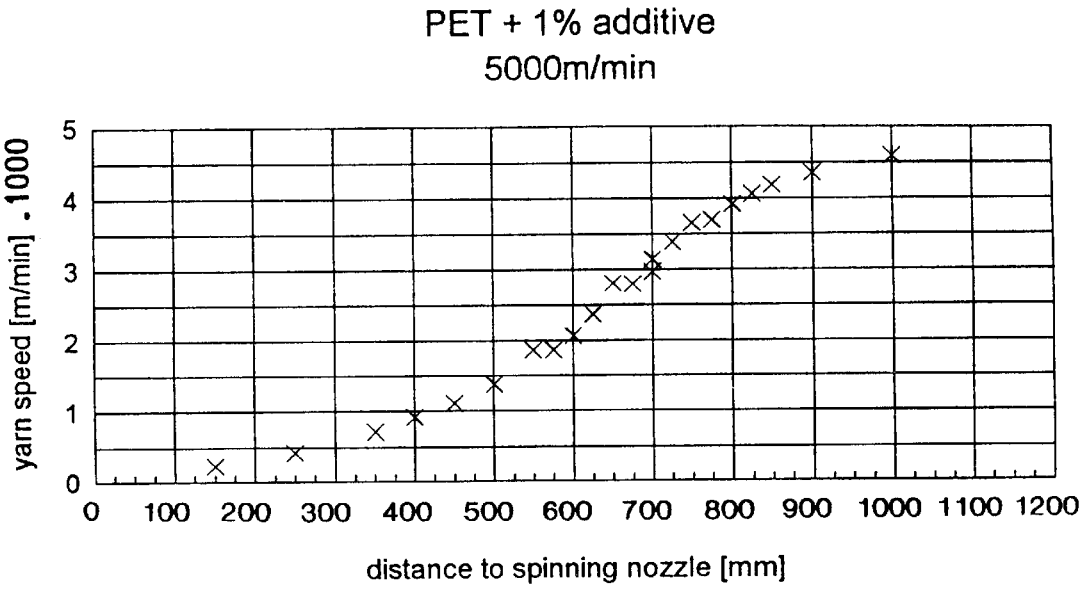
Figure 3B:
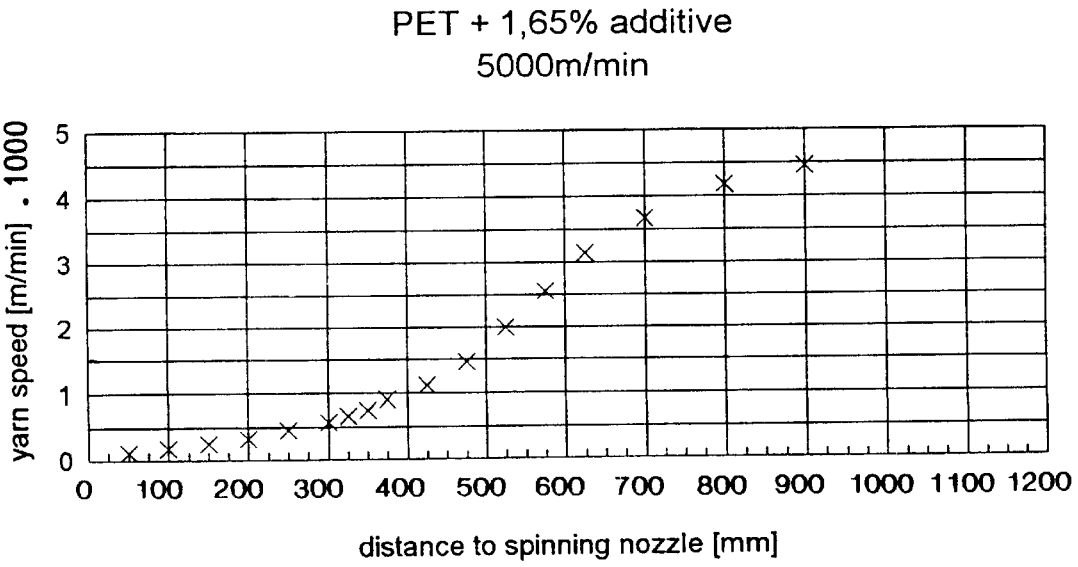

The measurements of the deformation zone in FIGS. 2 and 3 show that necking no longer occurs after experiment No. 4 (0.6% additive) and the variation in speed in the deformation zone becomes acceptable after experiment No. 5 (1.0% additive).

Figure 4A:
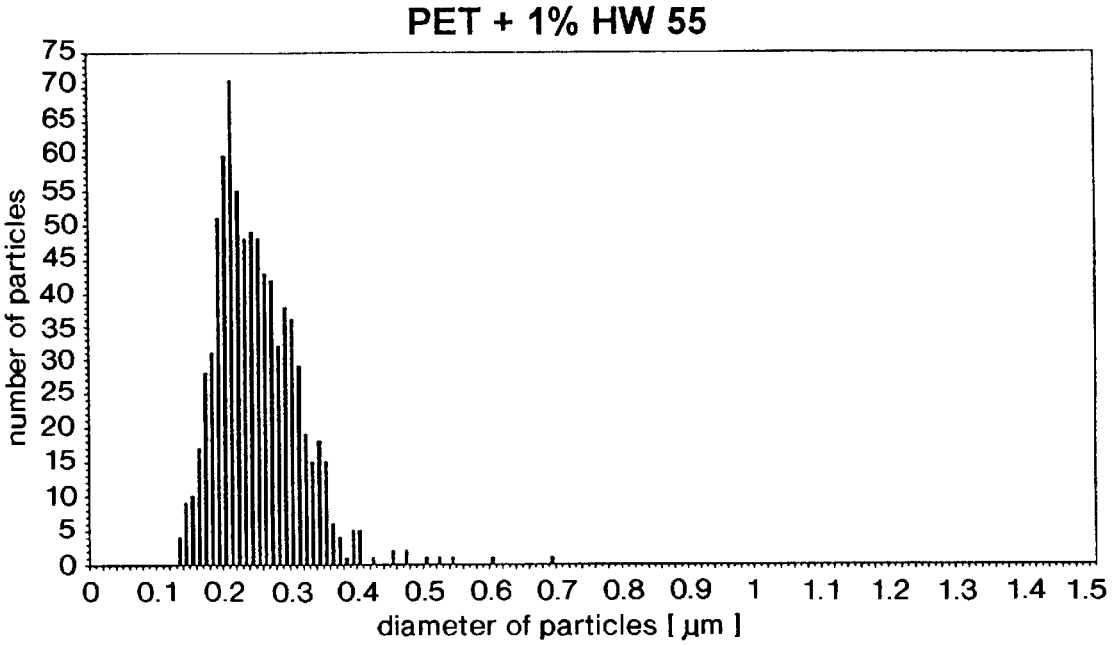
FIGS. 4 A–B displays examples of the distributions of the size of the additive particles in the polyester matrix of experiments 5 and 6 after leaving the nozzle bore.
Figure 4B:
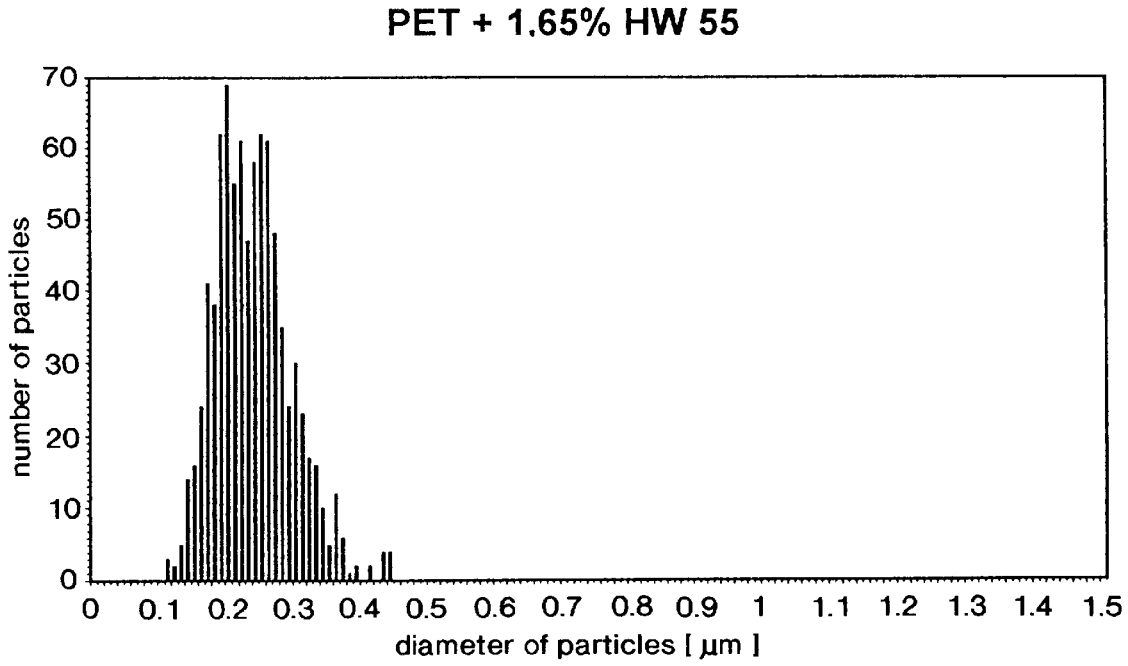

FIG. 4 shows examples of the distributions of the size of the additive particles in the polyester matrix of experiments 5 and 6 after leaving the nozzle bore. An average diameter of 235 nm was determined as $d_{50}$. The scattering was CV=25–26%. The maximum particle size in the specimens was 680 nm.

The spun fibers were draw textured as in Example 1, except that at higher texturing speeds the temperature in the first heater was increased to 220° C. The processing speed was increased to 1000 m/min in experiments 5 and 6 without any problems. The textile characteristics are summarized in Table 4.

In experiments nos. 3 and 4, the drawing ratio could not be set high enough because the tension was already too high. The depth of color in dyeing was improved significantly in comparison with the unmodified polymer, experiment No. 1.

TABLE 4

Results of draw texturing of experiments nos. 3–6:

| Experiment no. | 3 | 4 | 5 | 6 |
|---|---|---|---|---|
| Additive concentration (%) | 0.3 | 0.6 | 1.0 | 1.65 |
| Drawing ratio (1:) | 1.25 | 1.38 | 1.58 | 1.85 |
| Tension F1/F2 (cN) | 40/49 | 41/52 | 37/46 | 31/39 |
| Titer (dtex) | 105.6 | 95.9 | 83.7 | 72.1 |
| Tensile strength (cN/tex) | 37.6 | 39.0 | 40.1 | 37.3 |
| Elongation at break (%) | 28.1 | 27.5 | 25.4 | 22.0 |
| Crimp contraction (%) | 32.3 | 31.2 | 27.7 | 22.0 |
| Crimp retention (%) | 89.2 | 88.5 | 86.2 | 85.9 |
| Depth of color (%) | 172 | 173 | 160 | 146 |
| Processing behavior | – | – | + | + |

Example 3

In the spinning system according to Example 2 and under the same spinning conditions, the spinning draw-off speed was varied at a constant additive concentration of 1.2 wt %. The polymer throughput was adapted to the speed to achieve a constant spun fiber titer.

Figure 5A:
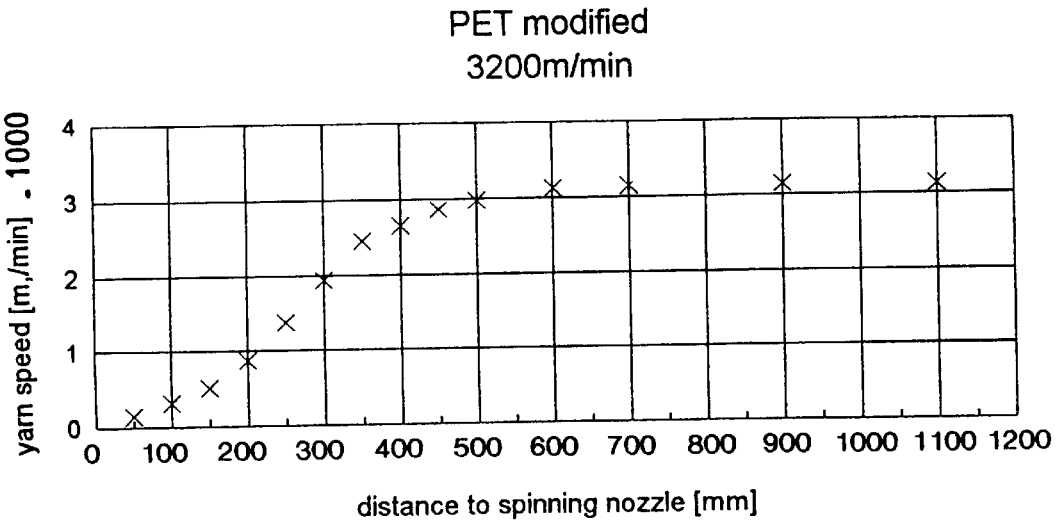
FIGS. 5 A–C and 6 A–B display the measurements of the deformation zone for Example 3.
Figure 5B:
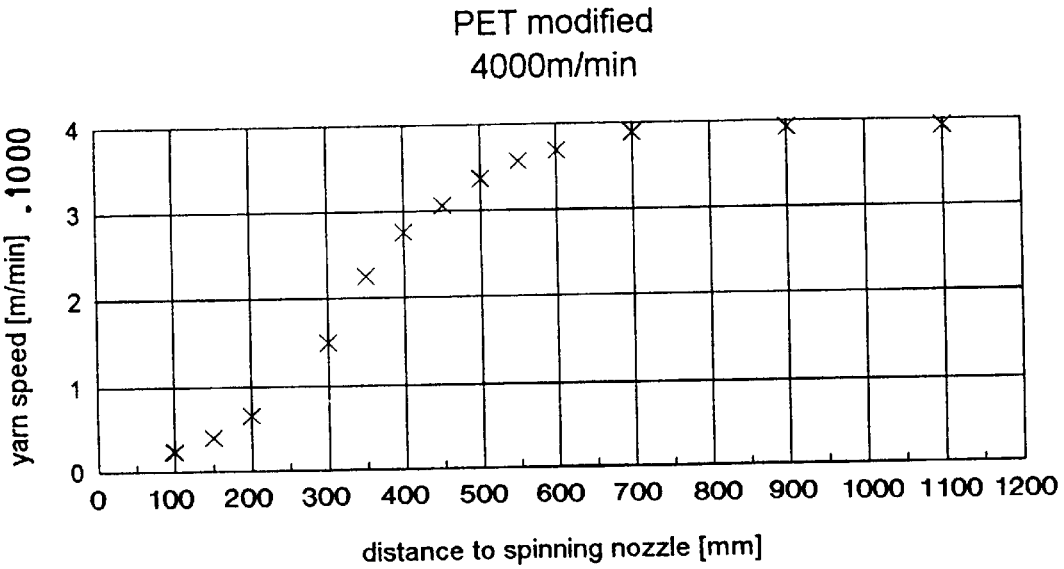
Figure 5C:
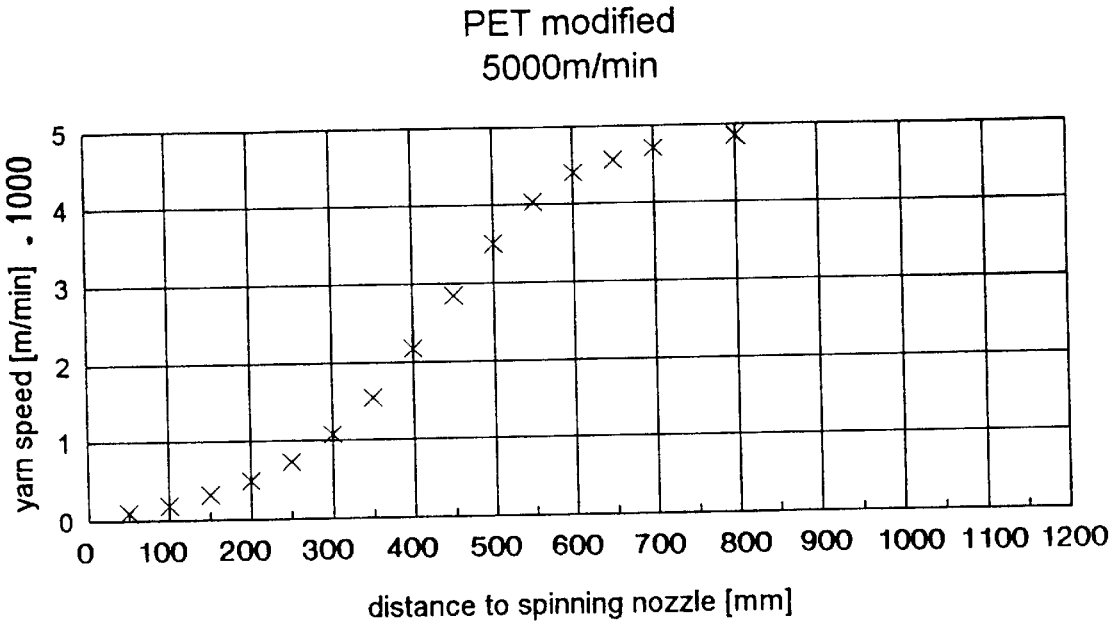
Figure 6A:
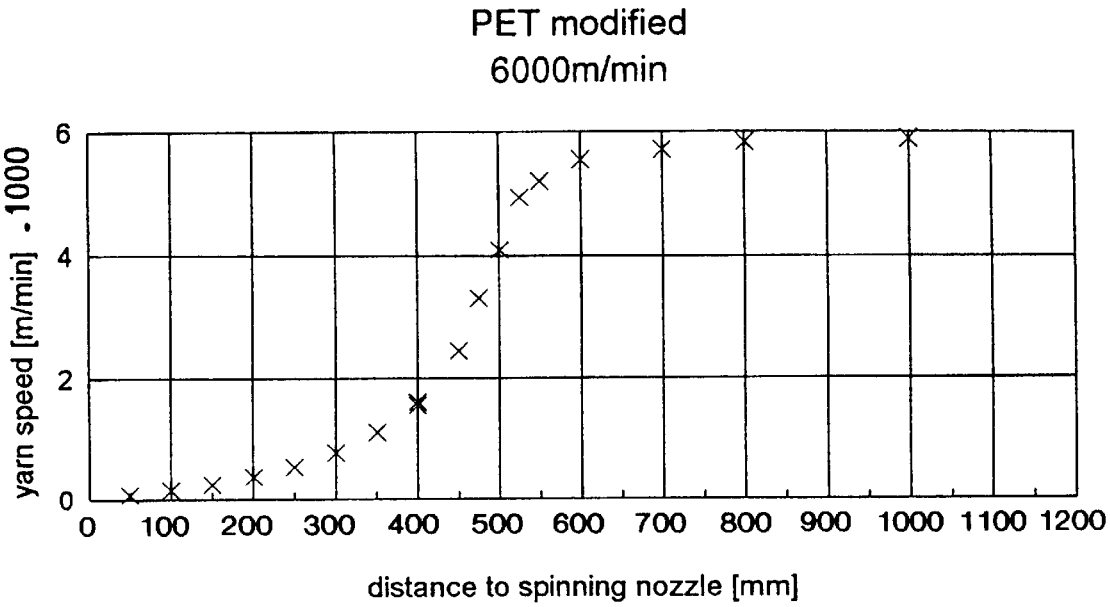
Figure 6B:
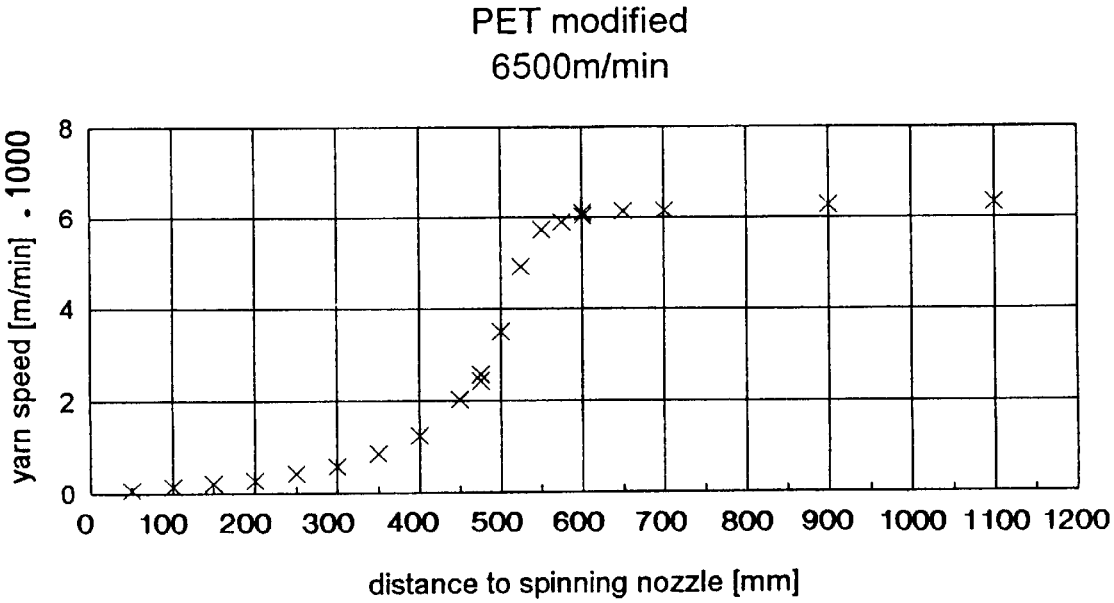

The characteristics of the spun fibers are summarized in Table 5 and the measurements of the deformation zone are illustrated in FIGS. 5 and 6.

TABLE 5

| Experiment no. | 7 | 8 | 9 | 10 | 11 |
|---|---|---|---|---|---|
| Spinning draw-off speed (m/min) | 3200 | 4000 | 5000 | 6000 | 650 |
| Throughput (g/min) | 44.0 | 53.0 | 63.0 | 75.6 | 81.9 |
| Nozzle pressure (bar) | 113 | 136 | 159 | 185 | 203 |
| Titer (dtex) | 138 | 133 | 128 | 124 | 130 |
| Tensile strength (cN/tex) | 18.4 | 20.8 | 22.4 | 23.4 | 22.9 |
| CV breaking load (%) | 2.7 | 3.1 | 2.3 | 3.3 | 2.4 |
| Elongation at break (%) | 177.6 | 144.8 | 118.4 | 86.4 | 84.1 |
| CV Elongation at break (%) | 2.0 | 2.1 | 2.4 | 3.3 | 3.1 |
| Uster - half inert (U %) | 0.2 | 0.34 | 0.34 | 0.26 | 0.44 |
| - normal (U %) | 0.55 | 0.63 | 0.52 | 0.57 | 0.76 |
| Shrinkage at boil (%) | 56.8 | 62 | 33.8 | 9.7 | 8.0 |
| Birefringence ($10^{-3}$) | 22.1 | 34.5 | 37.7 | 53.7 | 55.5 |
| Drawing zone (mm) | 248 | 313 | 337 | 219 | 189 |
| CV speed (%) | 2.3 | 2.5 | 2.6 | 3.1 | 9 |

The spun fibers were processed further on the draw texturing machine as in Example 2. The textile characteristics of the textured yarn are summarized in Table 6.

TABLE 6

Results of draw texturing of experiments nos. 7 through 11

| Experiment no. | 7 | 8 | 9 | 10 | 11 |
|---|---|---|---|---|---|
| Spinning draw-off (m/min) | 3200 | 4000 | 5000 | 6000 | 6500 |
| Drawing ratio (1:) | 2.17 | 1.88 | 1.64 | 1.43 | – |

TABLE 6-continued

Results of draw texturing of experiments nos. 7 through 11

| Experiment no. | 7 | 8 | 9 | 10 | 11 |
|---|---|---|---|---|---|
| Tension F1/F2 (cN) | 29/39 | 30/38 | 35/44 | 46/55 | |
| Titer (dtex) | 65.6 | 73.00 | 80.4 | 92.1 | |
| Tensile strength (cN/tex) | 38.6 | 41.2 | 41.0 | 35.5 | |
| Elongation at break (%) | 16.4 | 23.5 | 23.9 | 25.2 | |
| Crimp contraction (%) | 20.0 | 24.1 | 25.3 | 27.2 | |
| Crimp retention (%) | 84.0 | 85.8 | 85.7 | 84.8 | |
| Depth of color (%) | 89 | 104 | 129 | 182 | |
| Processing behavior | −* | +* | + | − | − |

*Texturing speed = 800 m/min

Experiment 7 does not allow a higher speed potential; experiment 8 is at the limits of a positive evaluation; experiments 10 and 11 yield excessive texturing tensions. The quantity of additive is well adapted to the speed in experiment No. 9.

The spun fibers of experiments nos. 10 and 11 were drawn at a temperature of 100° C., thermoset at 160° C., drawn off at a speed of 1200 m/min, and wound onto cops.

The running behavior was positive. The textile characteristics and the drawing ratio used in each case are shown in Table 7.

TABLE 7

| Experiment no. | 10 | 11 |
|---|---|---|
| Drawing ratio (1:) | 1.364 | 1.324 |
| Titer (dtex) | 94.9 | 99.3 |
| Tensile strength (cN/tex) | 32.3 | 32.9 |
| Elongation at break (%) | 32.7 | 31.7 |
| Processing behavior | + | + |

The fibers from both experiments could be used well for production of drawn yarns at high drawing speeds.

Example 4

In the spinning system according to Example 2 and except for the following variants under the same spinning conditions, two additional polymers were tested as additives with the concentrations adjusted accordingly. In this comparison in experiment No. 12 using nylon-66, type AS 2503 from BASF AG, Ludwigshafen, Germany, as the polymer additive, coarse steel pellets of a grain size of 250–350 $\mu$m were used in the spinning nozzle package. The nozzle pressure here was set at 113 bar at a throughput of 63 g/min. Experiment No. 12 with the previous pellet packing, however, yielded a nozzle pressure of 164 bar. In experiment No. 13, a polymer additive according to this invention, type GHT 120, of Degussa AG, Frankfurt, Germany, was added.

Figure 7A:
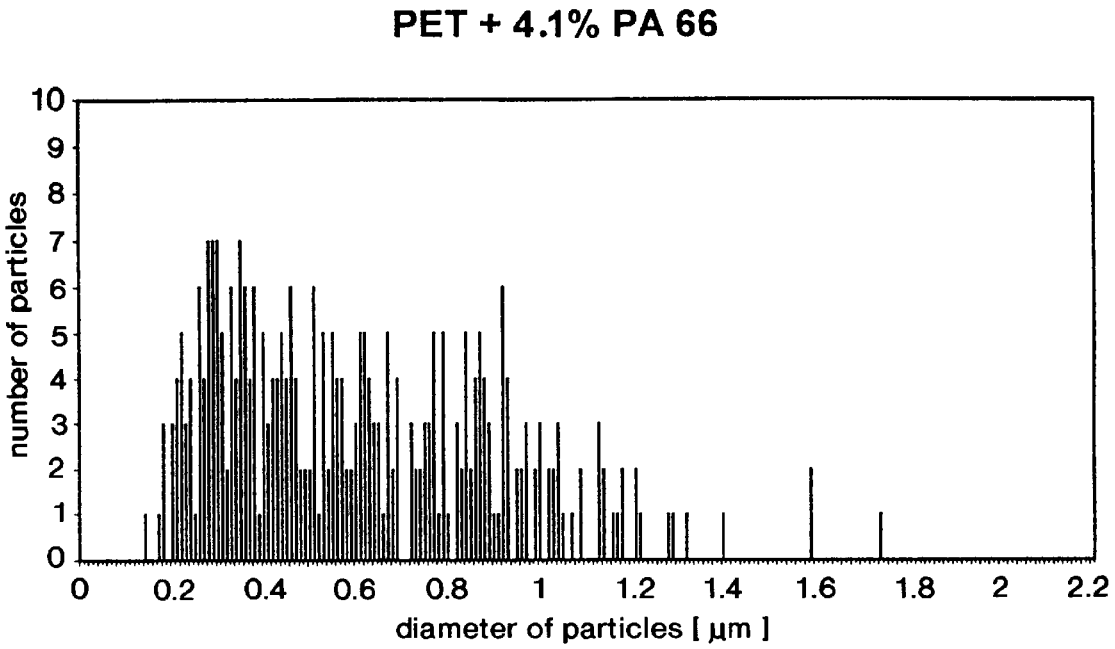
FIGS. 7 A–B shows the measurements of the additive distribution for Example 4.
Figure 7B:
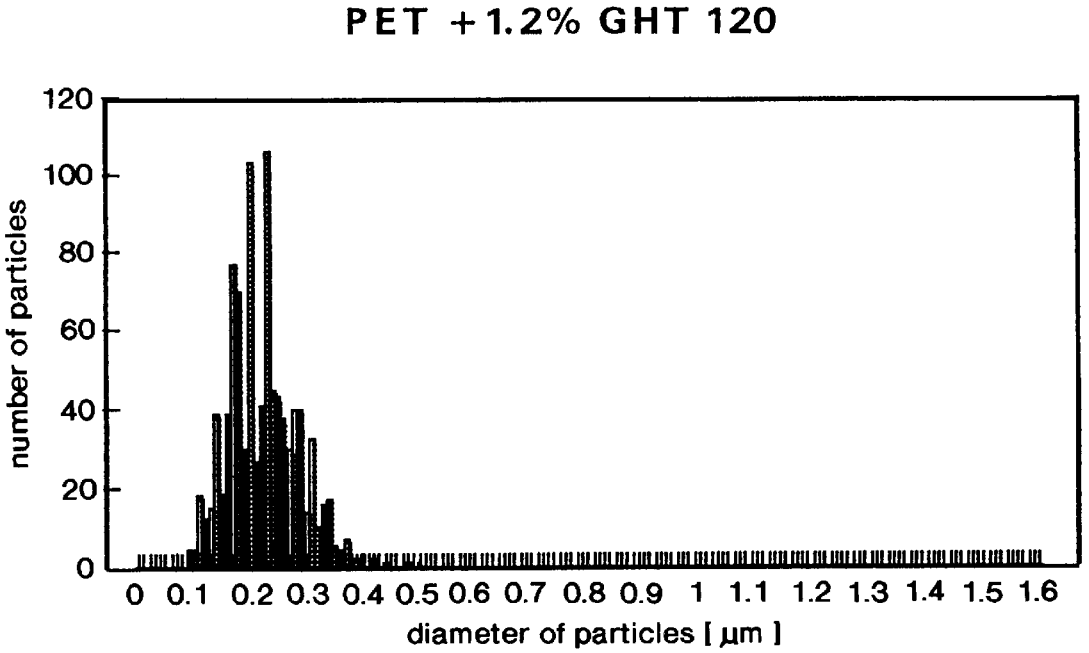

Table 8 shows the characteristic data on the spun fiber, and FIG. 7 shows the measurements of the additive distribution. Comparative experiment 12 shows a clearly inferior distribution; in experiment 12, the average diameter $d_{50}$=600 nm in comparison with 220 nm in experiment 13, CV=50% in comparison with 28% and the maximum diameter is 1740 nm in comparison with 500 nm.

The elongation at break is in the conventional range for POY in both experiments.

TABLE 8

| Experiment no. | 12 (Comparison) | 13 (Invention) |
|---|---|---|
| Type of additive | Nylon-66* | GHT 120** |
| Additive concentration (%) | 4.1 | 1.2 |
| Titer (dtex) | 126 | 129 |
| Tensile strength (cN/tex) | 20.4 | 22.2 |
| CV breaking load (%) | 2.7 | 2.6 |
| Elongation at break (%) | 112.3 | 116.8 |
| CV elongation at break (%) | 2.1 | 2.5 |
| Uster - half inert (U %) | 0.9 | 0.4 |
| Uster - normal (U %) | 1.39 | 0.77 |
| Shrinkage at boil (%) | 36.0 | 47.0 |
| Birefringence ($-10^{-3}$) | 42.0 | 38.2 |
| Drawing zone (mm) | 290 | 328 |
| CV speed (%) | very high | 2.4 |

*Polymer nylon-66, type AS 2503 from BASF AG, Ludwigshafen, Germany
**Copolymer with approximately 70–75% methyl methacrylate units, approximately 15–20% styrene units and approximately 10% maleic anhydride units, manufactured by Degussa AG, Frankfurt, Germany The spun fibers were processed further on the draw texturing machine as described in Example 2. The textile characteristics of the textured yarns are summarized in Table 9.

TABLE 9

Results of draw texturing from experiment No. 12 and 13

| Experiment No. | 12 (Comparison) | 13 (Invention) |
|---|---|---|
| Additive | Nylon-66 | GHT 120 |
| Drawing ratio (1:) | 1.44 | 1.44 |
| Tension F1/F2 (cN) | | 36/45 |
| Titer (dtex) | | 91.5 |
| Tensile strength (cN/tex) | | 41.0 |
| Elongation at break (%) | | 24.8 |
| Crimp contraction (%) | | 28.3 |
| Crimp retention (%) | | 87.9 |
| Processing behavior | −* | + |

*Texturing rate = 800 m/min

The draw texturing behavior in comparative experiment No. 12 was not stable and the speed could not be increased. We attribute this to a combination effect of the type of additive and the excessively large particles in the additive distribution.

Example 5

To polyethylene terephtlhalate with an intrinsic viscosity $\eta_{intr}$=0.64 dL/g and a residual water content of 43 ppm was added in a concentration of 0.4 wt %, as in Example 2, the polymer additive of type HW 55, and the mixture was melted in a single-screw extruder and sent to a spinning nozzle package at a temperature of 296° C. through a product line with nine static mixer elements from Sulzer AG, Zurich, Switzerland, model SMX, by means of a gear wheel metering pump.

The nozzle package contained a steel pellet volume, grain size 170–250 $\mu$m by analogy with Example 1, where a non-woven material of 10 $\mu$m was used as a super-fine filter, however. The spinning nozzle plate had 24 holes with the specifications given in Example 1. The nozzle pressure for the polymer throughputs used amounted to 183 or 188 bar. A $d_{50}$ of 240 nm was measured on the additive polymer in the polyester matrix after leaving the nozzle bore.

The melt fibers were cooled in a perforated tube by automatic air intake from the ambient air. At a distance of 1450 mm below the spinning nozzle, a preparation dose of 0.53% was applied to the fiber by means of a spinning oil-in-water emulsion. Next, the filaments were entangled in a jet at an air pressure of 5.5 bar and drawn off in a winder from Barmag AG, Remscheid, Germany, model CW8T, and wound up at various speeds.

The fibers produced had a nominal titer of 75f24 dtex, were highly oriented and did not require subsequent redrawing. The textile characteristics are shown in Table 10. The running properties were positive.

TABLE 10

| Experiment no. | 14 | 15 |
|---|---|---|
| Speed (m/min*) | 6500 | 7000 |
| Polymer throughput (g/min) | 46.6 | 50.2 |
| Titer (dtex) | 73.2 | 74.0 |
| Tensile strength (cN/tex) | 41.4 | 42.8 |
| CV breaking load (%) | 2.6 | 3.0 |
| Elongation at break (%) | 40.9 | 36.7 |
| CV elongation at break (%) | 5.9 | 6.3 |
| Uster - half inert (U %) | 0.23 | 0.37 |
| - normal (U %) | 0.61 | 0.78 |
| Tangling knots (n/m) | 11 | 9 |
| Drawing zone (mm) | 106 | 73 |

*Draw-off speed = speed (m/min). 1.0046

Example 6

In the spinniing system according to Example 2 and except for the following variations under the same spinning conditions, an additional copolymer consisting of about 83 wt % methyl methacrylate and about 17 wt % styrene was tested as an additive with varied concentration. The nozzle pressure was set at 170 bar at a throughput of 63 g/min.

Table 11 shows the characteristic data of the spun fiber. The elongation. at break is in the conventional range for POY in both experiments.

TABLE 11

| Experiment No. | 16 | 17 |
|---|---|---|
| Additive concentration (%) | 0.65 | 0.72 |
| Titer (dtex) | 129 | 129 |
| Tensile strength (cN/tex) | 23.4 | 22.3 |
| CV breaking load (%) | 2.8 | 2.7 |
| Elongation at break (%) | 115.4 | 122.9 |
| CV elongation at break (%) | 2.9 | 2.5 |
| Uster - half inert (U %) | 0.45 | 0.48 |
| Uster - normal (U %) | 0.90 | 0.98 |
| Shrinkage at boil (%) | — | 61.3 |
| Birefringence ($\times 10^{-3}$) | — | 50.8 |

The spun fibers were processed further on the draw texturing machine as described in Example 2. The textile characteristics resulting from the draw texturing of experiments 16 and 17 are summarized in Table 12.

TABLE 12

| Experiment | 16 | 17 |
|---|---|---|
| Drawing ratio (1:_) | 1.72 | 1.81 |
| Tension F1/F2 (cN) | 30/40 | 33/43 |
| Titer (dtex) | 85.8 | 73.4 |
| Tensile strength (cN/tex) | 36.7 | 40.8 |
| Elongation at break (%) | 18.6 | 17.5 |
| Processing behavior | + | + |

We claim:

1. A process of producing filaments with an elongation at break of ≦180% comprising processing polymer blends based on polyester or polyamide by adding an amorphous second polymer to the polyester or polyamide in the amount of 0.05 to 5 wt %, wherein the second polymer is a copolymer composed of at least two of the following monomer units:

0 to 90 wt % A, wherein A is a monomer of formula $CH_2{=}C(R)—COOR^1$, wherein R is —H or —$CH_3$ and $R^1$ is straight or branched chain $C_1$–$C_{10}$ alkyl or cyclohexyl, 0 to 40 wt % B, wherein B is a monomer of maleic acid or maleic anhydride, and 5 to 85 wt % C, wherein C is a monomer of styrene or methyl substituted styrene such that (wt % A+wt % B+wt % C)=100%, and subjecting the resulting blend to high-speed spinning at a draw-off speed of ≧1500 m/min to form filaments.

2. The process according to claim 1, wherein said processing comprises treating the melt mixture under shearing so that the average particle size ($d_{50}$) of the second polymer immediately after leaving the spinning nozzle is at most 400 nm.

3. The process according to claim 1, wherein when the filaments are used as roving for draw texturing, the draw-off speed is in the range of 2500 to about 8000 m/min and the amount of second polymer added is at most M, wherein M is defined as:

$$M = \left[\frac{1}{1600} \cdot v(\mathrm{m/min}) - 1\right]\%.$$

4. The process according to claim 3, wherein the amount M of second polymer added is a least $$M = \left[\frac{1}{1600} \cdot v(\mathrm{m/min}) - 2.48\right]\%.$$

5. The process according to claim 3, wherein at a draw-off rate of at least 2500 m/min, the amount of second polymer added is adjusted to result in a deformation zone having a length between 250 and 700 mm.

6. The process according to claim 3, wherein the filaments are first wound onto bobbins and then sent to a draw texturing machine at a processing rate of at least 750 m/min.

7. The process according to claim 1, wherein the filaments are first wound onto bobbins and then sent to a drawing machine at a processing rate of at least 800 m/min.

8. The process according to claim 1, wherein after spinning and drawing off, the filaments are drawn mechanically directly between godet wheels, thermoset, and wound onto bobbins as fully drawn yam at a winding rate of ≧4000 m/min.

9. The process according to claim 1, characterized in that a fully drawn highly oriented yarn (HOY) resulting from spin drawing is obtained at winding speeds of ≧6000 m/min.

10. The process according to claim 9, wherein the amount of second polymer added, P, is at most $$P = \left[\frac{1}{1600} \cdot v(\mathrm{m/min}) - 3.46\right]\%.$$

11. The process according to claim 1, wherein the second polymer consists of 50 to 85 wt % A, 5 to 20 wt % B and 5 to 30 wt % C.

12. The process according to claim 11, wherein the second polymer consists of 60 to 80 wt % methyl methacrylate units, 5 to 15 wt % maleic anhydride units and 5 to 25 wt % styrene units, wherein wt % methyl methacrylate units+wt % maleic anhydride units+wt % styrene units=100%.

13. The process according to claim 1, wherein $R^1$ is methyl, ethyl, n-propyl, n-butyl, iso-butyl, 2-ethyl-butyl, 2-ethyl hexyl, n-hexyl, n-heptyl, or cyclohexyl and C is styrene, α-methyl styrene, 3-metlhyl styrene, or 4-methyl styrene.

14. The process according to claim 13, wherein said processing comprises treating the melt mixture under shearing so that the average particle size ($d_{50}$) of the second polymer immediately after leaving the spinning nozzle is at most 400 nm.

15. The process according to claim 13, wherein when the filaments are used as roving for draw texturing, the draw-off speed is in the range of 2500 to about 8000 m/min and the amount of second polymer added is at most M, wherein M is defined as:

$$M = \left[\frac{1}{1600} \cdot v(\mathrm{m/min}) - 1\right]\%.$$

16. The process according to claim 15, wherein the amount M of second polymer added is a least $$M = \left[\frac{1}{1600} \cdot v(\mathrm{m/min}) - 2.48\right]\%.$$

17. The process according to claim 15, wherein at a draw-off rate of at least 2500 m/min, the amount of second polymer added is adjusted to result in a deformation zone having a length between 250 and 700 mm.

18. The process according to claim 15, wherein the filaments are first wound onto bobbins and then sent to a draw texturing machine at a processing rate of at least 750 m/min.

19. The process according to claim 13, wherein the filaments are first wound onto bobbins and then sent to a drawing machine at a processing rate of at least 800 m/min.

20. The process according to claim 13, wherein a fully drawn highly oriented yarn (HOY) resulting from spin drawing is obtained at winding speeds of ≧6000 m/min.

21. The process according to claim 13, wherein C is styrene.

22. The process according to claim 1, wherein the second polymer consists of 70 to 90 wt % A and 10 to 30 wt % C, wherein wt % A+wt % C=100%.

* * * * *